United States Patent [19]

Gutman et al.

[11] 3,983,013

[45] Sept. 28, 1976

[54] METHOD OF ELECTROLYTIC BORATING OF ARTICLES

[76] Inventors: Mark Borisovich Gutman, 4 Grazhdanskaya ulitsa, 43, korpus 2, kv. 5; Vsevolod Grigorievich Kaufman, Petroverigsky pereulok, 3, kv. 24; Mikhail Savelievich Gorodinsky, Snezhnaya ulitsa, 4, kv. 24; Jury Alexandrovich Shakhnes, Zarevsky proezd, 5, kv. 32; Larisa Sergeevna Mezhueva, Novoslobodskaya ulitsa, 52, kv. 11; Irina Stepanovna Altukhova, prospekt Vernadskogo, 33, kv. 188, all of Moscow, U.S.S.R.; Jury Grigorievich Kaloshin, deceased, late of Moscow, U.S.S.R.; by Albina Adolfovna Kaloshina, administratrix, Chertanovskaya ulitsa, 24, korpus 2, kv. 138, Moscow, U.S.S.R.

[22] Filed: Sept. 23, 1974

[21] Appl. No.: 508,216

Related U.S. Application Data

[63] Continuation of Ser. No. 382,846, July 26, 1973, abandoned.

[52] U.S. Cl. ..... 204/39; 204/243 R; 204/274

[51] Int. Cl.[2] ..... C25D 9/08; C25D 11/00; C25D 3/66

[58] Field of Search ..... 204/39, 64 R, 243 R, 204/244–247, 274

[56] References Cited

UNITED STATES PATENTS

| | | | |
|---|---|---|---|
| 2,741,587 | 4/1956 | Sindeband | 204/243 R X |
| 3,024,176 | 3/1962 | Cook | 204/39 |
| 3,048,497 | 8/1962 | Möller | 204/225 X |
| 3,405,043 | 10/1968 | Barakat et al. | 204/243 R X |
| 3,746,628 | 7/1973 | Kannenburg et al. | 204/39 |

*Primary Examiner*—G. L. Kaplan
*Attorney, Agent, or Firm*—Holman & Stern

[57] ABSTRACT

A method of electrolytic borating with a crucible holding a melt of boron-bearing medium in which anodes and articles under treatment are immersed, both being connected to a source of direct current, and electrodes for the electrical heating of the melt are accommodated inside the crucible and immersed directly in the melt, with the electrodes being connected to a source of alternating current. The electrodes are so positioned with respect to the anodes and the articles being treated so that the direct-current density on the surface of the articles is in excess of the alternating - current density.

1 Claim, 1 Drawing Figure

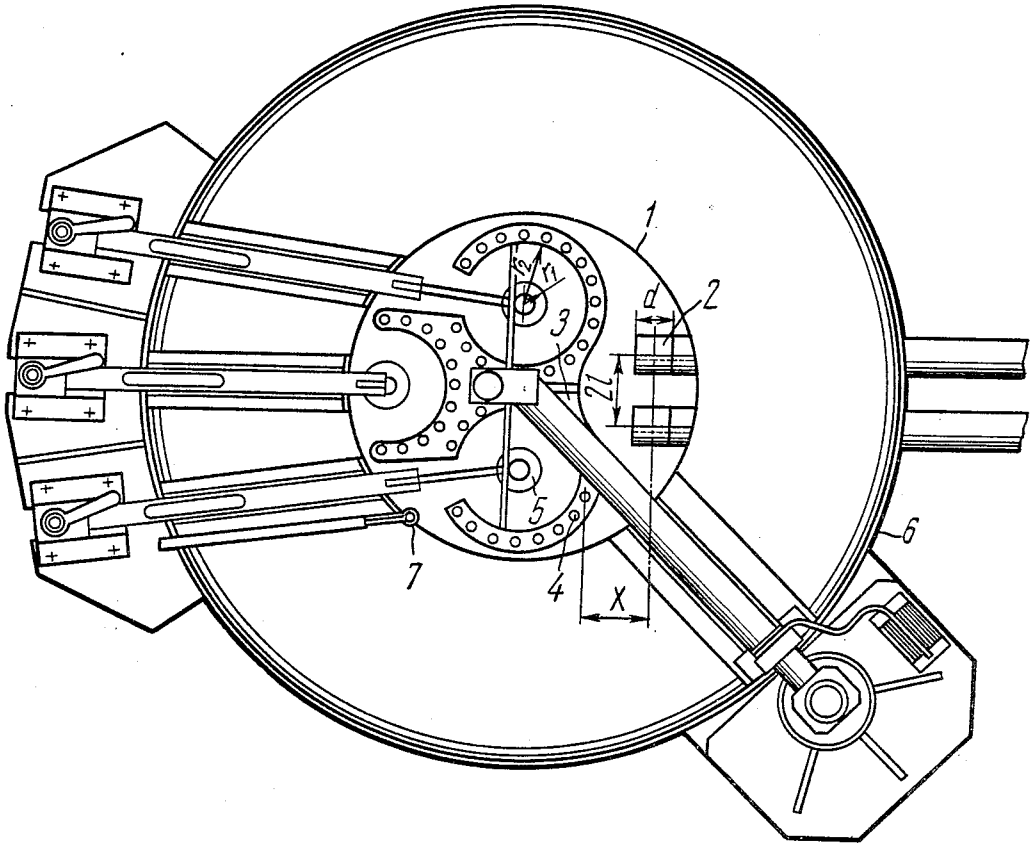
1
2
3
4
5
6
7
d
l
x

METHOD OF ELECTROLYTIC BORATING OF ARTICLES

This is a continuation of application Ser. No. 382,846, filed July 26, 1973, and now abandoned.

BACKGROUND OF THE INVENTION

The present invention relates to methods used in thermochemical treatment, and more particularly, in the process of borating various articles.

PRIOR ART

Known in the art is a device for electrolytic borating with an external heating of a boron-containing melt. The device is essentially a crucible electric furnace, comprising a welded metal shell lined with a refractory material. The furnace accommodates a metal melting pot of chromium-nickel alloyed steel and containing the melt of a boron-bearing medium.

The melt of a boron-bearing medium and an electric device defined by open-type resistive heater elements serving as the source of heat, are separated from each other by the metal wall of the pot.

To establish the process of electrolysis, anodes are provided inside the pot, immersed in the melt therein, with the anodes being connected to the positive pole of a D.C. source. The negative pole of the source is connected to articles being treated which are immersed in the melt.

In the known device discussed above, the average service life of a pot is about two thousand hours, which is a substantial disadvantage inherent thereof, since failure of the pot involves also the destruction of the resistive heater elements and refractory lining, thus necessitating a complete reinstallation of the whole device.

OBJECTS AND SUMMARY OF THE INVENTION

It is an object of the present invention to provide a method for electrolytic borating utilizing a device which has a service life longer than that of the known device.

It is another object of the present invention to decrease the specific consumption of electric power and to make the process of electrolytic borating less expensive.

These and other objects are achieved by using a device for electrolytic borating of articles, comprising a crucible holding melt of a boron-bearing medium in which are immersed anodes and articles being treated, with the anodes and the articles being respectively connected to the positive and the negative poles of a D.C. source, the device being based upon the principle that when direct current is passed through the melt of a boron-bearing medium which is heated, the formation of a diffuse boron-coated layer on the surface of the articles under treatment results. According to the invention, the means for the electric heating of the melt of a boron-bearing medium is accommodated inside the crucible directly in the melt and has electrodes connected to an A.C. source, with the electrodes being spaced at such a distance from the anodes and the articles being treated that the direct-current density on the surface of the latter is in excess of the alternating-current density.

In the present device, the distance between the anodes, the electrodes and the articles under treatment is determined by the following formulas:

$$R_{a.c.} = \frac{\rho \ln \left[ \frac{2l}{d} + \sqrt{\left(2\frac{l}{d}\right)^2 - 1} \right]}{H \operatorname{arc\,tg} \frac{2\frac{x}{d}}{\sqrt{\left(2\frac{l}{d}\right)^2 - 1}}};$$

$$R_{d.c.} = \frac{\rho}{2\pi h} \ln \frac{r_2}{r_1},$$

where $R_{a.c.}$ — resistance in the circuit of A.C. electrodes, ohm;

$R_{d.c.}$ — resistance in the electrolysis circuit, ohm;

$\rho$ — resistivity of the boron-bearing medium, ohm.cm;

H — effective length of A.C. electrodes, *m;*

*d* — diameter (side of a square) of A.C. electrodes, *m;*

*l* — spacing of A.C. electrodes, *m;*

*h* — length of articles being treated, m;

X — current coordinate making allowance for the arrangement of articles in the working space of the device;

$r_1$ — radius of a D.C. anode, *m;*

$r_2$ — inside radius of the cathode which is essentially the holder with the articles under treatment, *m.*

The principal advantage offered by the present invention is a more than fivefold increase in the average service life of crucible due to the electric heater device being placed immediately in the melt of a boron-bearing medium which results in a reduced temperature of the crucible walls and an increased service life thereof.

Determining of the distance between the anodes, the electrodes and the articles under treatment according to the above formulas ensures that for every article being treated the requirement is met that the direct-current density on the surface thereof is found to be in excess of the alternating-current density.

The provision and application of the present device reduces the specific consumption of electric power and render the process of electrolytic borating less expensive thus resulting in a substantial economic advantage.

BRIEF DESCRIPTION OF THE DRAWINGS

To promote an understanding of the essence of the present invention, given below is a disclosure of a specific exemplary embodiment of the device used in carrying out the method to be taken in conjunction with the accompanying drawing, wherein the sole FIGURE is a general diagrammatic view of a device for electrolytic borating of articles.

DETAILED DESCRIPTION OF THE INVENTION

Now referring to the drawing, the device comprises a crucible 1 of a Ni-Cr steel casting. Accommodated inside the crucible which is filled with melt of a boron-bearing medium, is an electrical appliance defined by two electrodes 2 of Nichrome alloy. The electrodes 2 are connected to an A.C. source (not shown). Immersed in the boron-bearing medium are articles 4 under treatment enclosed in a special holder 3 which serve as the cathode and are connected to the negative pole of a D.C. source (not shown), while connected to the positive pole of the source are graphite anodes 5 immersed in the melt.

The crucible 1 is accommodated in a refractory-lined shell 6. To measure the melt temperature, a thermocouple 7 is provided.

The device used in the invention operates as follows:

Once the melt of a boron-bearing medium has been prepared, the electrodes 2 connected to an A.C. source (not shown) and adapted to heat up the melt are energized. The temperature of the melt is controlled by means of the Chromel-Alumel thermocouple 7 enclosed in a protective stainless-steel casing.

Both charging and discharging of the articles 4 in the holder 3 are power-assisted. The articles are immersed in the melt at a temperature of 950°C.

Further, to effect the electrolysis process, the D.C. source is connected and a predetermined value of current density on the surface of the articles 4 is set, with the result that the electrolysis of the melt of the boron-bearing medium proceeds, under which the melt becomes dissociated with the formation of the ions of boron and the deposition thereof upon the surface of the articles 4 under treatment.

With the electrode method of heating the melt of a boron-bearing medium, the articles 4 under treatment are exposed to the effect of the direct current of the electrolysis and of the sinusoidal alternating current of the electrodes 2. Inasmuch as the process of electrochemical dissociation of the melt of a boron-bearing medium and the transfer of ions to the surface of the articles 4 under treatment occur only during the cathode half-wave, the presence of the anode component of alternating current leads to a retardation of electrochemical reactions and, under certain conditions, even in their reversal.

Whenever the amplitude density of alternating current is lower than the density of direct current, there is passed through the surface of the articles being treated a total current devoid of the anode component and thus enabling a continuous proceeding of electrochemical reactions accompanied by the evolution of the necessary products of electrolysis.

In the present device, the mutual arrangement of the articles, the anodes and the electrodes of the electrical appliance for heating the melt, in the working space of the device, as well as electrical parameters (voltage in the circuit of the heater electrodes and in the electrolysis circuit) ensure that for every article under treatment, the condition holds true under which the direct-current density on the surface thereof is in excess of the alternating-current density. Such mutual arrangement and electrical parameters are found from estimated dependencies interrelating the geometrical parameters of the present device, with the dependencies being in turn determined by proceeding from the known value of the resistance in the circuit of A.C. electrodes and that of the resistance in the electrolysis circuit, using the formulas stated hereinbefore.

Given below is an exemplary mutual arrangement of A.C. electrodes, anodes and the articles under treatment as found in accordance with the aforestated dependencies, which affords the conditions under which the alternating-current density on the surface of any article under treatment is lower than the density of the direct current.

EXAMPLE

For borating cylindrical articles 16 mm in diameter and 310 mm long of carbon low-silchrome steel, in a boron-bearing medium having a resistivity of 1.86 ohm.cm, the device for electrolytic borating, according to the invention has the following geometrical parameters found in the table below:

Table

Geometrical Parameters of Device for Electrolytic Borating

| No. | Description of geometrical parameter | Symbol | Dimension | Numerical value |
|---|---|---|---|---|
| 1. | Spacing of A.C. electrodes | l | m | 0.060 |
| 2. | Diameter of A.C. electrode | d | m | 0.060 |
| 3. | Effective length of electrodes | H | m | 0.5 |
| 4. | Current coordinate making allowance for position assumed by article in working space of device | X | m | 0.1 |
| 5. | Inside radius of holder | $r_2$ | m | 0.2 |
| 6. | Radius of D.C. anode | $r_1$ | m | 0.0375 |

The application of the device for the electrolytic borating of the articles ensures the obtaining of a uniform boron-coated layer for a depth of 0.12–0.20 mm at a temperature of the process ranging from 940° to 950°C, with direct-current density on the surface of the articles under treatment being equal to 0.10–0.15 A/cm² and duration of the process equal to 3 hours.

What we claim is:

1. A method of electrolytic borating articles comprising the steps of: filling a crucible with a melt of a boron-bearing medium; immersing electrodes connected to a source of alternating current, a holder enclosing articles and connected to the negative terminal of a source of direct current, and anodes connected to the positive terminal of the source of direct current in the melt; energizing the electrodes to heat the melt; energizing the anodes and the holder to form a diffuse boron-plated layer on the surface of the articles; and maintaining the distances between the electrodes, the anodes and the articles so that the density of the direct current on the surface of the articles is greater than the density of the alternating current, as determined by the following formulas:

$$R_{a.c.} = \frac{\rho \cdot \ln \left[ \frac{2l}{d} + \sqrt{2\left(\frac{l}{d}\right)^2 - 1} \right]}{H \cdot \operatorname{arc\,tg} \frac{2\frac{x}{d}}{\sqrt{2\left(\frac{l}{d}\right)^2 - 1}}};$$

$$R_{d.c.} = \frac{\rho}{2\pi h} \cdot \ln \frac{r_2}{r_1}$$

where $R_{a.c.}$ = resistance in the circuit of A.C. electrodes, ohm;

$R_{d.c.}$ = resistance in the electrolytic circuit, ohm;

$\rho$ = resistivity of the boron-bearing medium, ohm.cm;

H = effective length of A.C. electrodes, *m;*

*d* = diameter (side of a square) of A.C. electrodes, *m;*

*l* = spacing of A.C. electrodes, *m;*

*h* = length of articles, *m;*

X = current coordinate making allowance for the position of the articles in the working space of the crucible, *m;*

$r_1$ = radius of a D.C. anode, *m;* and $r_2$ = inside radius of the cathode which is essentially the holder with the articles, *m.*

* * * * *